US005856815A

United States Patent [19]

Mochizuki et al.

[11] Patent Number: 5,856,815

[45] Date of Patent: Jan. 5, 1999

[54] METHOD OF DRIVING SURFACE-STABILIZED FERROELECTRIC LIQUID CRYSTAL DISPLAY ELEMENT FOR INCREASING THE NUMBER OF GRAY SCALES

[75] Inventors: Akihiro Mochizuki; Shigeo Kasahara; Katsusada Motoyoshi, all of Kawasaki, Japan

[73] Assignee: Fujitsu Limited, Kawasaki, Japan

[21] Appl. No.: 680,980

[22] Filed: Jul. 16, 1996

Related U.S. Application Data

[63] Continuation of Ser. No. 539,945, Oct. 6, 1995, abandoned, which is a continuation of Ser. No. 223,319, Apr. 5, 1994, abandoned, which is a continuation of Ser. No. 945,712, Sep. 16, 1992, abandoned.

[30] Foreign Application Priority Data

Oct. 7, 1991 [JP] Japan ..... 3-259110

[51] Int. Cl.[6] ..... G09G 3/36

[52] U.S. Cl. ..... 345/97; 345/89

[58] Field of Search ..... 345/97, 89, 212, 345/94; 349/100–103, 104, 37, 128, 133

[56] References Cited

U.S. PATENT DOCUMENTS

| | | | |
|---|---|---|---|
| 4,747,671 | 5/1988 | Takahashi et al. | 359/56 |
| 4,921,334 | 5/1990 | Akodes . | |
| 4,925,277 | 5/1990 | Inaba | 359/56 |
| 5,061,044 | 10/1991 | Matsunaga | 359/56 X |
| 5,066,945 | 11/1991 | Kanno et al. | 359/56 X |
| 5,289,175 | 2/1994 | Kawagishi | 345/212 |
| 5,650,869 | 7/1997 | Kojima et al. | 349/104 |

FOREIGN PATENT DOCUMENTS

| | | | |
|---|---|---|---|
| 0 224 243 | 6/1987 | European Pat. Off. . | |
| 0 272 079 | 6/1988 | European Pat. Off. . | |
| 0 360 402 | 3/1990 | European Pat. Off. . | |
| 0 400 992 | 12/1990 | European Pat. Off. . | |
| 2 585 163 | 1/1987 | France . | |
| 2178582 | 2/1987 | United Kingdom | 359/56 |
| 89/05025 | 6/1989 | WIPO . | |

OTHER PUBLICATIONS

Clark et al., "Submicrosecond bistable electro–optic switching in liquid crystals," Appl. Phys. Lett 36(11), 1 Jun. 1980.

Handschy et al., "Stroboscopic microscopy of fast electro–optic switching in ferroelectric smectic C liquid crystals", Appl. Phys. Lett. 41(1), 1 Jul. 1982.

Hartmann et al., "A Passive–Matrix–Addressed Ferroelectric Liquid–Crystal Video Display," *Proceedings of the SID*, vol. 32/2, 1991, pp.115–120.

Yabe et al., "A 5–Mpixel Overhead Projection Display Utilizing a Nematic Cholesteric Phase–Transition Liquid Crystal," *SID 91 Digest*, pp. 261–264.

Wakita et al., "Gray Scales on Ferroelectric Liquid Crystals by Weighted Subfield," *National Technical Report*, vol. 38, No. 3, Jun. 1992, pp. 45–49.

*Primary Examiner*—Amare Mengistu
*Attorney, Agent, or Firm*—Staas & Halsey

[57] ABSTRACT

A method for driving a surface-stabilized ferroelectric liquid crystal display element uses a selection voltage, a half-selection voltage, and a non-selection voltage. A relative ratio between the selection voltage, half-selection voltage, and non-selection voltage of a drive signal is changed, or absolute levels of the selection voltage, half-selection voltage, and non-selection voltage are changed. Consequently, a plurality of gradations of the surface-stabilized ferroelectric liquid crystal display element can be obtained.

22 Claims, 14 Drawing Sheets

4-SLOT METHOD (1/4 BIAS METHOD)

SHIFT REGISTER FOR SIGNAL ELECTRODE
15
LATCH CIRCUIT
16
DECODER
17
DATA DRIVER
18
2Vx
0
-2Vx
FERROELECTRIC LIQUID CRYSTAL PANEL
11
2Vx
-2Vx
SW1
SW2
Vx
0.5Vx
-0.5Vx
-Vx
SCAN DRIVER
14
SHIFT REGISTER FOR SCAN ELECTRODE
13
DATA SIGNAL
12
SIGNAL GENERATION PORTION
SCAN SIGNAL
FRAME-INVERSION CONTROL SIGNAL

METHOD OF DRIVING SURFACE-STABILIZED FERROELECTRIC LIQUID CRYSTAL DISPLAY ELEMENT FOR INCREASING THE NUMBER OF GRAY SCALES

This application is a continuation of application Ser. No. 08/539,945, filed Oct. 6, 1995, now abandoned, which is a continuation of Ser. No. 08/223,319, filed on Apr. 5, 1994, now abandoned, which is a continuation of Ser. No. 07/945,712 filed on Sep. 16, 1992, now abandoned.

BACKGROUND OF THE INVENTION

1. Field of the Invention

The present invention relates to a method of driving a ferroelectric liquid crystal display element, more particularly, to a method of driving a surface-stabilized ferroelectric liquid crystal display element to increase the number of gray scales (gradations).

2. Description of the Related Art

In recent years, as office automation has advanced, use of so called OA-equipment such as word processors and personal computers has become widely spread. In particular, light and compact OA-equipment such as lap-top and palm-top devices are demanded as personal-use equipment. For this compact OA-equipment, compact keyboards and displays are needed as human interfaces. In particular, displays serving as faces of the equipment are needed not only to be light and compact but also to be flat, thin, and high quality.

Namely, in recent years, to meet the requirements of lightness, compactness, flatness, thinness, and high quality, liquid crystal displays (LCDs) are widely used. Note, the LCDs are compact, light, and thin, to consume small electric power, provide relatively high information content, and be able to display colors. Therefore, LCDs nearly satisfy the requirements for the displays of the OA-equipment.

Incidentally, a conventional supertwisted LCD (STN-LCD) may have an information content of about 1200×800 pixels at the maximum. Since this display has a long response time, a cursor on a screen of the display moved by a mouse cannot follow the movements of the mouse, so that it is not satisfactory as a display for a computer that uses a mouse. The STN-LCD has another problem of deteriorating a contrast ratio in proportion to an increase in the display capacity. In particular, a high resolution display with 1200×800 pixels achieves an insufficient contrast ratio of about only 8:1. The most serious problem of the STN-LCD is a narrow viewing angle (narrow angle of visibility), which is about only 30 degrees with respect to a normal angle to the screen. Accordingly, the contrast ratio and colors change depending on an angle of view, and therefore, the STN-LCD is not convenient for a user to use. The STN-LCDs must solve these problems.

To solve these problems of the STN-LCDs, a ferroelectric liquid crystal display (FLCD) having fast-switching and bistable surface stabilized liquid crystal (SSFLC) structure has been proposed (for example, Appl. Phys. Lett. Vol. 36, p. 899 (1980) by N. A. Clark et al). The FLCD (SSFLC device) is bistable in terms of electro-optical characteristics, so that it may materialize a high information content with use of a memory effect of liquid crystals. Since a drive time per scan line of the FLCD is very short about 100 $\mu$sec., a cursor on a screen of the FLCD sufficiently follows the movements of a mouse. Liquid crystal molecules of the FLCD are always in parallel with a substrate (a glass supported substrate) irrespective of the presence of an applied electric field, so that the FLCD provides a very wide viewing angle, and the display properties of the FLCD are substantially independent of an angle of visibility.

As explained above, the FLCD is very promising as a large capacity OA display but inferior in display quality. Namely, the FLCD involves insufficient display gradations. Since the FLCD is basically bistable, it basically achieves binary display of black and white.

Conventionally, there are three methods that have been provided to increase the number of gray scales (gradations) of a ferroelectric liquid crystal display element. One technique is a so called domain size control method (for example, disclosed in Proceedings of the SID (Society for Information Display), Vol. 32/2, pp. 115 to 120, (1991) by W. J. A. M. Hartmann et al.), another technique is a so called pulse modulation method (for example, disclosed in National Technical Report Vol. 38, No. 3, pp. 313 to 317 (1992) by N. Wakita et al.), and still another technique is a so called dithering method (for example, disclosed in SID DIGEST (1991) pp. 261 to 264 by T. Yoshihara et al).

First, in the domain size control method, which may be called a texture-method, as described in Proceedings of the SID, Vol. 32/2, pp. 115 to 120, (1991) by W. J. A. M. Hartmann et al., a plurality of gradations can be obtained by controlling an inversion state of liquid crystal domains provided in one pixel. Namely, a molecular orientation of the liquid crystal provided in one pixel (element) is not uniform and is divided into some domains. The domain size control method controls the number of inversion of the divided domains, and changes the area of "Black" (or "White") in one pixel like a dithering method, so that a plurality of gradations can be obtained.

Next, in the pulse modulation method, as described in National Technical Report Vol. 38, No. 3, pp. 313 to 317 (1992) by N. Wakita et al., a plurality of gradations can be obtained by controlling the number of inversions of a drive voltage in a constant period by changing the pulse numbers. Namely, the pulse modulation method controls the pulse width of a pulse voltage to be applied to the liquid crystal element to increase the number of gray scales (gradations). Note, this pulse modulation method is broadly used in nematic liquid crystal device such as an STN-LCD, and the gradations can be largely increased by slowing the response time thereof.

Finally, in the dithering method, as described in SID DIGEST (1991) pp. 261 to 264 by T, Yoshihara et al., a plurality of gradations can be obtained by controlling the number of sub-pixels constituting one pixel. For example, one pixel is constituted by four or nine sub-pixels, and each of the sub-pixels is independently controlled as "White" or "Black". Note, this dithering method is well known and is also described in a part of Proceedings of the SID, Vol. 32/2, pp. 115 to 120, (1991) by W. J. A. M. Hartmann et al. Further, the dithering method is a technique similar to dot-photographs used in a newspaper, and the like.

The technique of changing the pulse width of a pulse voltage to be applied to liquid crystals does not sufficiently function with the present response speed of liquid crystals, so that it may display four gradations at the maximum. On the other hand, the dithering method requires a very large number of pixels, which increases the number of drive circuits and cost.

Note, the present invention method can also use the above method, as the present invention method and the prior art methods can be independently applied to a ferroelectric liquid crystal display element to increase the number of gray scales (gradations). Further, the present invention method can be applied not only to OA-equipment such as word processors and personal computers, but also applied to an electronic OHP display (with reference to SID DIGEST (1991) pp. 261 to 264 by T, Yoshihara et al.), and the like.

SUMMARY OF THE INVENTION

An object of the present invention is to provide a method of effectively displaying gradations with a ferroelectric liquid crystal display element. Namely, an object of the present invention is to provide a method of driving a ferroelectric liquid crystal display element to increase the number of gray scales.

According to the present invention, there is provided a method of driving a surface-stabilized ferroelectric liquid crystal display element by a selection voltage, half-selection voltage, and non-selection voltage, wherein, a relative ratio between the selection voltage causing polorization inversion, half-selection voltage causing partial polarization inversion, and non-selection voltage not causing polarization inversion of a drive signal is changed to display a plurality of gradations of the surface-stabilized ferroelectric liquid crystal display element. The relative ratio between the selection voltage, half-selection voltage, and non-selection voltage of the drive signal may be changed for every frame or every several frames and applied to the liquid crystal display element.

Further, according to the present invention, there is also provided a method of driving a surface-stabilized ferroelectric liquid crystal display element by a selection voltage, half-selection voltage, and non-selection voltage, wherein, absolute levels of the selection voltage, half-selection voltage, and non-selection voltage are changed to display a plurality of gradations of the surface-stabilized ferroelectric liquid crystal display element. The absolute levels of the selection voltage, half-selection voltage, and non-selection voltage of the drive signal may be changed for every frame or every several frames and applied to the liquid crystal display element.

The method may further use a pulse modulation method to increase the gradations of the liquid crystal display element. The pulse width of each of the selection voltage, half-selection voltage, and non-selection voltage of the drive signal may be changed to display a plurality of gradations of the liquid crystal display element. The method may further use a domain size control method or dithering method to increase the gradations of the liquid crystal display element.

In addition, there is provided a method of driving a surface-stabilized ferroelectric liquid crystal display element driven by a drive signal, wherein the drive signal includes at least two positive voltage levels and two negative voltage levels to at least one of scan and signal electrodes of the surface-stabilized ferroelectric liquid crystal display element.

The drive signal including a plurality of voltage levels may be changed for every frame or every several frames and applied to the liquid crystal display element. The voltage levels of the drive signal may include at least two different pulse widths.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

The preferred embodiments of a method of driving a ferroelectric liquid crystal display element, according to the present invention, will be explained with reference to the accompanying drawings.

Figure 1A:
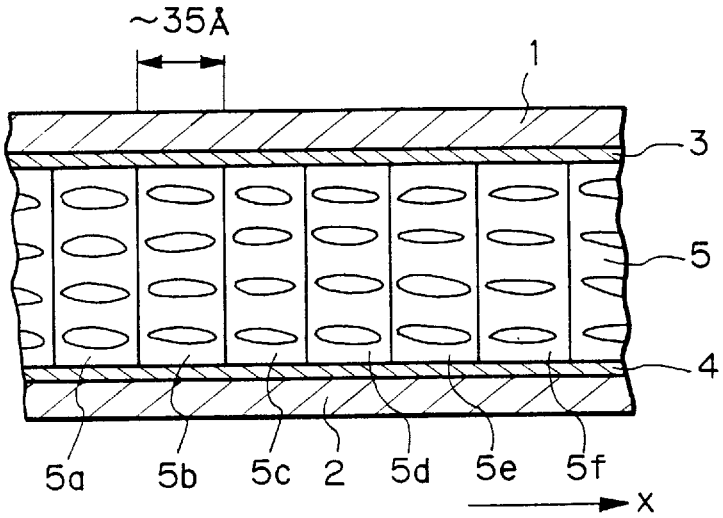
FIGS. 1A and 1B are diagrams explaining a ferroelectric liquid crystal display element employed by the present invention.
Figure 1B:
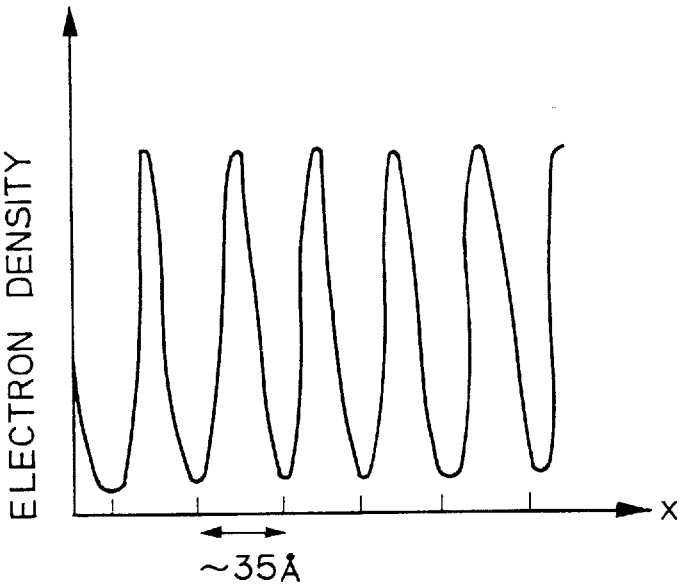

FIGS. 1A and 1B are diagrams explaining a ferroelectric liquid crystal display element employed by the present invention. In FIG. 1A, reference numerals 1 and 2 denote insulation substrates, 3 denotes a signal electrode, 4 denotes a scan electrode, and 5 denotes ferroelectric liquid crystal. Note, FIG. 1 shows a sectional diagram of a part of one pixel (ferroelectric liquid crystal display element).

In FIG. 1A, the ferroelectric liquid crystal display device including a plurality of ferroelectric liquid crystal display elements comprises ferroelectric liquid crystal 5, e.g., naphthalene-based liquid crystals held between the insulation substrates 1 and 2 made of, for example, glass plates facing each other. The ferroelectric liquid crystal display element uses the naphthalene-based liquid crystal material having a layer (bookshelf) structure and surface-stabilized ferroelectric liquid crystal (SSFLC) structure to realize fast-switching and bistable characteristics. Namely, the ferroelectric liquid crystal display element applying the present invention method uses a surface-stabilized ferroelectric liquid crystal material, such a naphthalene-based liquid crystal.

The insulation substrate 1 is provided with a plurality of signal electrodes (data electrodes) 3, i.e., transparent electrodes made of, for example, ITO. The other insulation substrate 2 is provided with a plurality of scan electrodes 4, i.e., transparent electrodes made of, for example, ITO. The signal electrodes 3 formed on the insulation substrate 1 are orthogonal to the scan electrodes 4 formed on the insulation substrate 2, to form a matrix of pixels, or display elements.

Note, the method of driving the ferroelectric liquid crystal display element according to the present invention is applicable not only for the above described simple matrix liquid crystal display device, but also for various types of liquid crystal display devices. Further, as described above, the ferroelectric liquid crystal display element using ferroelectric liquid crystal has a bookshelf structure (layer structure) and SSFLC-structure to realize fast-switching and bistable characteristics.

Namely, as shown in FIG. 1A, the ferroelectric liquid crystal disposed between the two insulation substrates 1 and 2 is constructed as a layer structure (bookshelf structure) of layers 5*a,* 5*b,* 5*c,* . . . at predetermined intervals (for example, about 35 Å), due to molecular arrangement of liquid crystal molecules caused by interface effects by gaps of the insulation substrates 1 and 2, and due to molecular interactions among smectic liquid crystals. As shown in FIG. 1B, concentration of electrons in the ferroelectric liquid crystal display element periodically changes at intervals of, for example, about 35 Å. Note, the method of the present invention is used to drive the ferroelectric liquid crystal display element having such layer structure and SSFLC structure. Namely, the method of the present invention drives a surface-stabilized ferroelectric liquid crystal display element to increase the number of gray scales (gradations).

Figure 2:
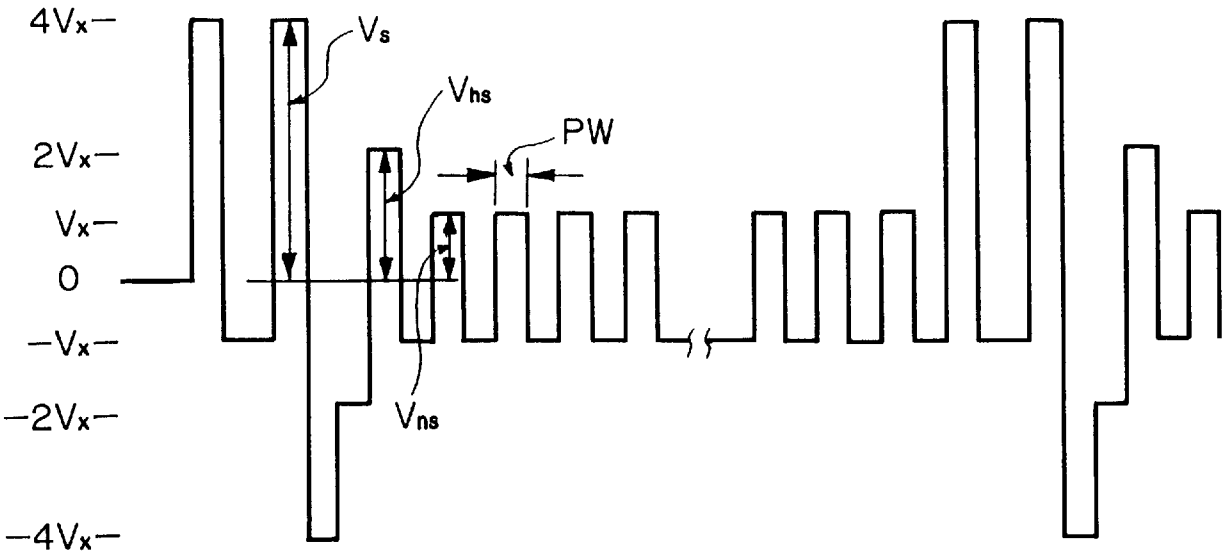
FIG. 2 is a diagram explaining a 4-slot method employed by a method of driving a ferroelectric liquid crystal display element according to the present invention.

FIG. 2 is a diagram explaining a 4-slot method employed by a method of driving a ferroelectric liquid crystal display element according to the present invention. In FIG. 2, a reference mark Vx denotes a basic voltage, Vs denotes a selection voltage (write voltage) causing polarization inversion, Vhs denotes a half-selection voltage causing partial polarization inversion, and Vns denotes a non-selection voltage causing no polarization inversion.

As shown in FIG. 2, the 4-slot method (¼ bias method) sets the level of the selection voltage Vs to 4Vx, that of the half-selection voltage Vhs to 2Vx, and that of the non-selection voltage Vns to Vx, to realize a ratio (Vs:Vhs:Vns) of 4:2:1 to drive the liquid crystal display element.

Figure 3:
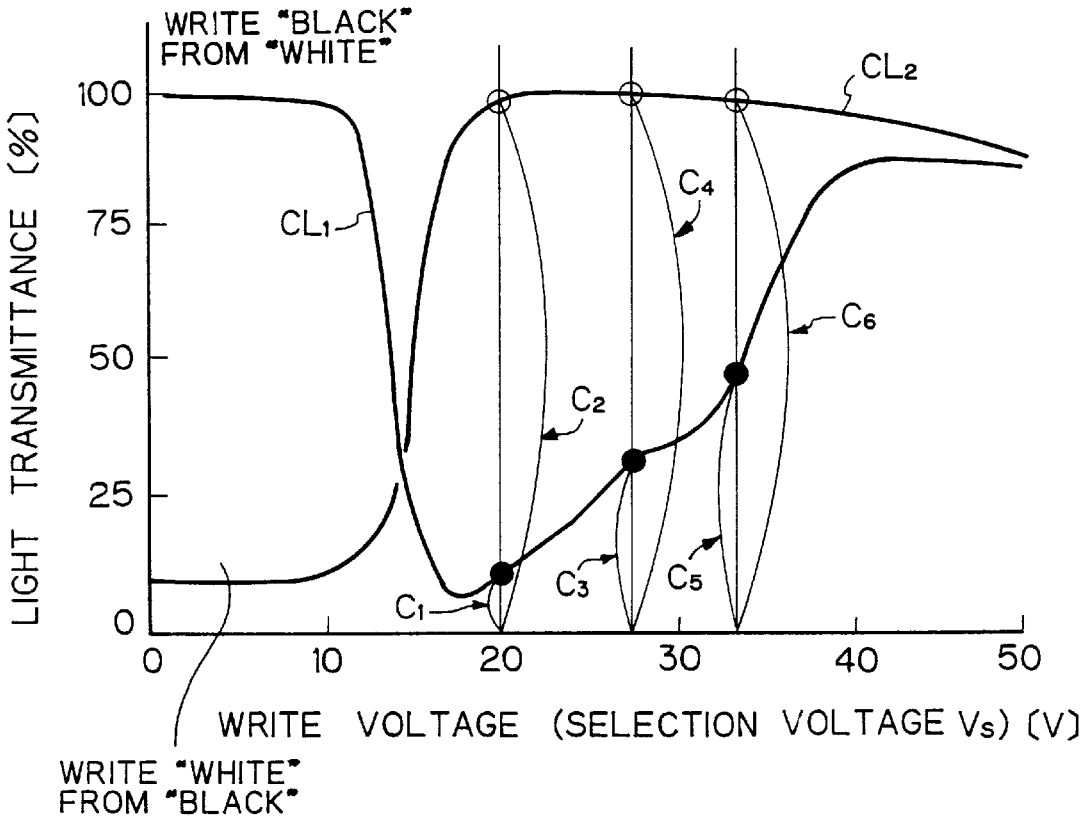
FIG. 3 is a diagram for explaining a first principle of the method of driving a ferroelectric liquid crystal display element according to the present invention.

FIG. 3 shows a first principle of the method of driving a ferroelectric liquid crystal display element according to the present invention.

As shown in FIG. 3, a write voltage (selection voltage Vs) for the ferroelectric liquid crystal display element is increased from 0 V to write "black" from "white". Namely, as shown in a characteristic line $CL_1$ of FIG. 3, light transmittance decreases accordingly, reaches the lowest value at about 17 V, and then increases when the write voltage is further increased from 17 V.

On the other hand, a write voltage (Vs) for the ferroelectric liquid crystal display element is increased from 0 V to write "white" from "black". Namely, as shown in a characteristic line $CL_2$ of FIG. 3, light transmittance increases and maintains the highest value (nearly 100%) over about 19 V.

Note, the present invention utilizes such characteristics of the ferroelectric liquid crystal display element, and the present invention changes voltage levels of the 4-slot method explained with reference to FIG. 2, to display different gradations (gray scales).

When a ratio (Vs:Vhs:Vns) between the selection voltage Vs, half-selection voltage Vhs, and non-selection voltage Vns is unchanged at, for example, 4:2:1, and when an overall voltage, i.e., the basic voltage Vx is changed, different gradations can be obtained. Namely, as shown in FIG. 3, when the selection voltage Vs is 20 V (corresponding to the voltage Vx being 5 V), a contrast ratio of $C_2/C_1$ is obtained. Further, when the selection voltage Vs is 28 V (corresponding to the voltage Vx being 7 V), a contrast ratio of $C_4/C_3$ is obtained, and when the selection voltage Vs is 32 V (corresponding to the voltage Vx being 8 V), a contrast ratio of $C_6/C_5$ is obtained. As a result, different gradations (at contrast ratios of $C_2/C_1$, $C_4/C_3$, and $C_6/C_5$) can be displayed by changing the basic voltage Vx.

Figure 4:
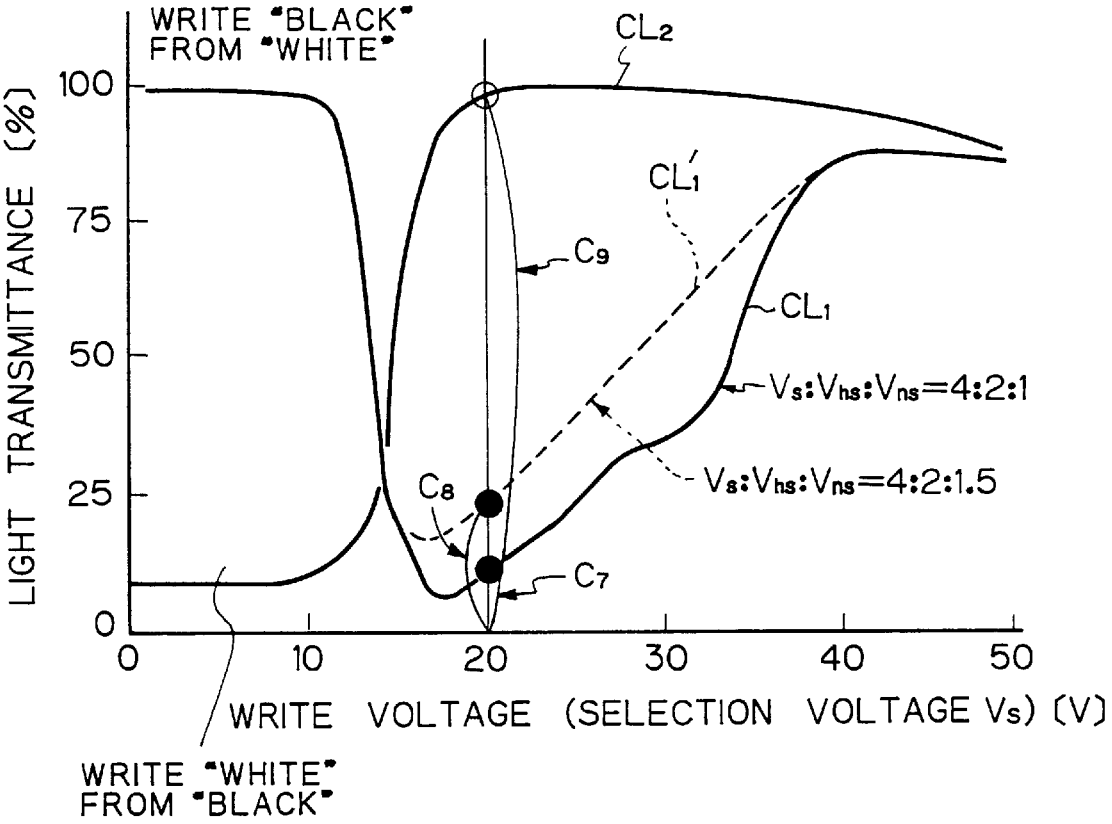
FIG. 4 is a diagram for explaining a second principle of the method of driving a ferroelectric liquid crystal display element according to the present invention.

FIG. 4 shows a second principle of the method of driving a ferroelectric liquid crystal display element according to the present invention.

As shown in FIG. 4, a write voltage (selection voltage Vs) for the ferroelectric liquid crystal display element is increased from 0 V to write "black" from "white". Namely, as shown in a characteristic line $CL_1$ of FIG. 4 (which is the same as that of FIG. 3), light transmittance decreases accordingly, reaches the lowest value at about 17 V, and then increases when the write voltage is further increased from 17 V. Further, a write voltage (Vs) for the ferroelectric liquid crystal display element is increased from 0 V to write "white" from "black". Namely, as shown in a characteristic line $CL_2$ of FIG. 4 (which is the same as that of FIG. 3), light transmittance increases and maintains the highest value (nearly 100%) over about 19 V.

As shown in FIG. 4, when a ratio (Vs:Vhs:Vns) between the voltages of the 4-slot method is changed from 4:2:1 to 4:2:1.5, the characteristics change from a continuous line $CL_1$ to a dotted line $CL'_1$ in FIG. 4. Namely, even when the selection voltage Vs is fixed at 20 V (corresponding to the voltage Vx being fixed at 5 V), different gradations (at contrast ratios of $C_9/C_7$ and $C_9/C_8$) can be displayed by setting the ratio Vs:Vhs:Vns to 4:2:1 and 4:2:1.5.

Therefore with the selection voltage Vs being fixed at 20 V, a ratio of the selection voltage Vs to non-selection voltage Vns is changed to display different gradations. Note, a ratio of the selection voltage Vs to half-selection voltage Vhs can be changed to similarly display different gradations.

In addition, a pulse width PW shown in FIG. 2 can be changed to provide different gradations. This technique can be combined with the method of changing a ratio between the selection voltage Vs, half-selection voltage Vhs, and non-selection voltage Vns and the method of changing the levels of these voltages, to easily provide various gradations that are actually required.

The method of driving a ferroelectric liquid crystal display element according to the present invention employs the above first and second principles explained with reference to FIGS. 3 and 4, to provide a plurality of gradations (gray scales).

Next, experimental data obtained by using the present invention methods will be explained.

The following FLCDs (ferroelectric liquid crystal displays, or surface-stabilized ferroelectric liquid crystal displays) were fabricated to examine changes in a multiple drive bias ratio, i.e., a driving margin (window, or threshold characteristics) due to changes in the relative voltage levels of the selection voltage Vs, half-selection voltage Vhs, and non-selection voltage Vns.

First, a glass substrate having a circular transparent electrode of 15 mm in diameter was cleaned, coated with polyvinyl alcohol by a spin coater, and baked for one hour to form a PVA film of 500 Å thick. The surface of the film was rubbed by a nylon cloth to form a liquid crystal panel with glass balls of 1.6 μm in mean particle diameter as spacers. The panel was filled with mixed liquid crystals (ferroelectric liquid crystal material described in "Ferroelectrics" Vol. 113, pp. 353 to 359 by A. Mochizuki et al.), which mainly contained naphthalene-based liquid crystals, to complete the FLCD.

The panel was multiple-driven according to a 4-slot waveform (FIG. 2), and relationships between threshold characteristics, bias ratios, and relative values of the Vs, Vhs, and Vns were measured.

Figure 5:
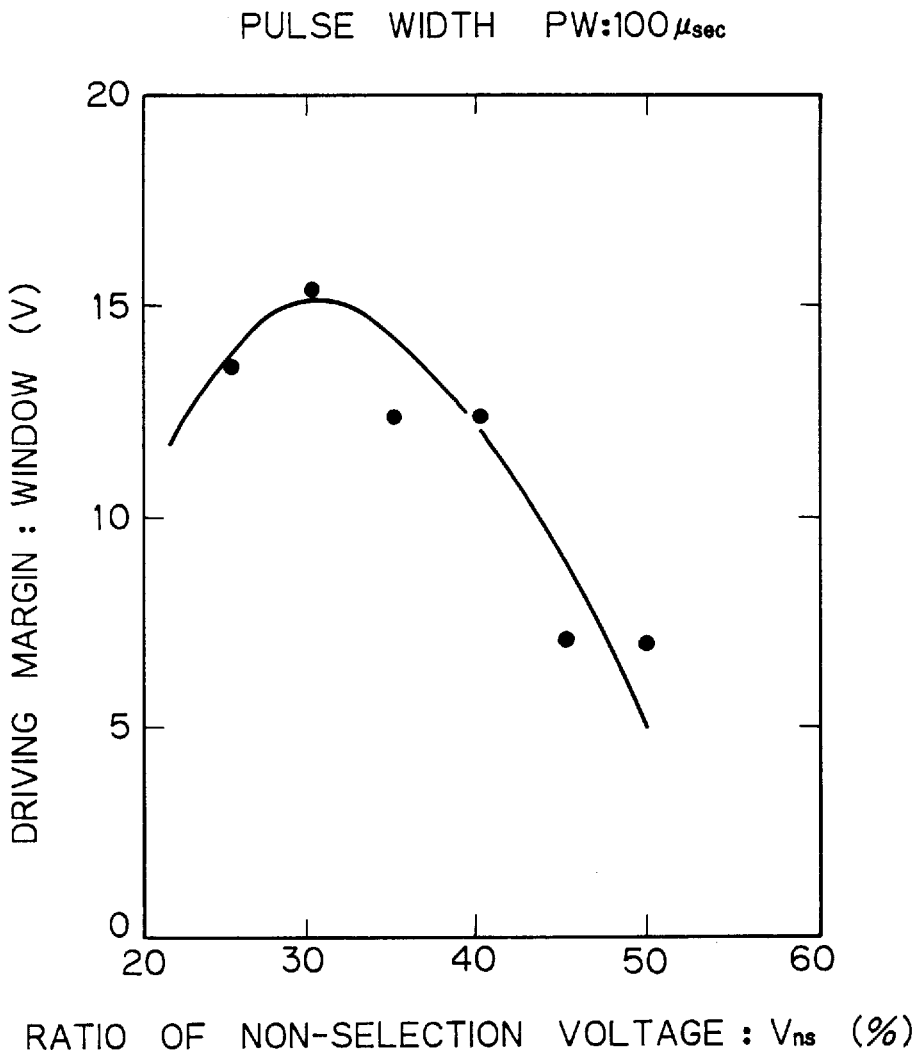
FIG. 5 is a diagram showing relationships between percentages of a non-selection voltage and light transmittance under the condition of 100 μsec. pulse width, for explaining the method of driving a ferroelectric liquid crystal display element according to the present invention.
Figure 6:
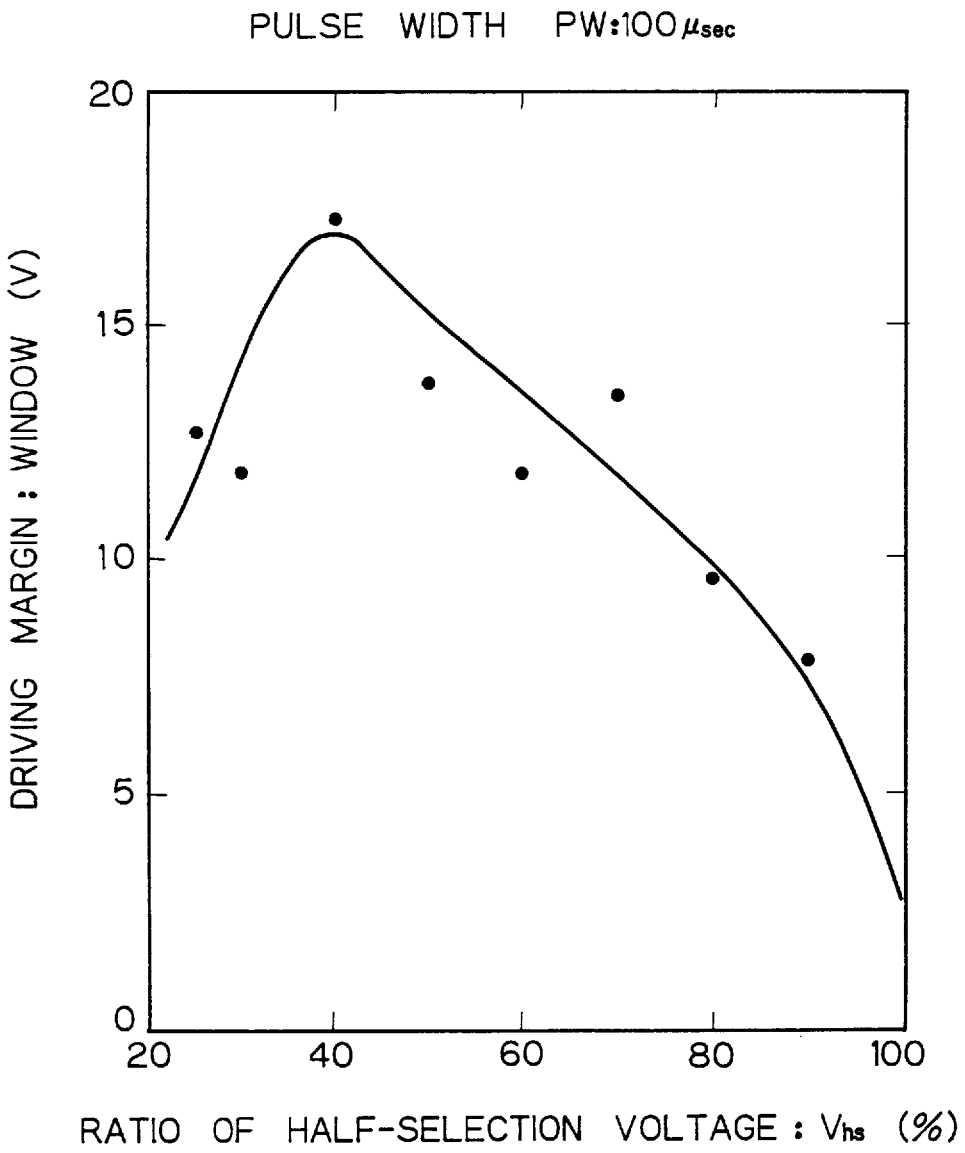
FIG. 6 is a diagram showing relationships between percentages of a half-selection voltage and light transmittance under the condition of 100 μsec. pulse width, for explaining the method of driving a ferroelectric liquid crystal display element according to the present invention.
Figure 7:
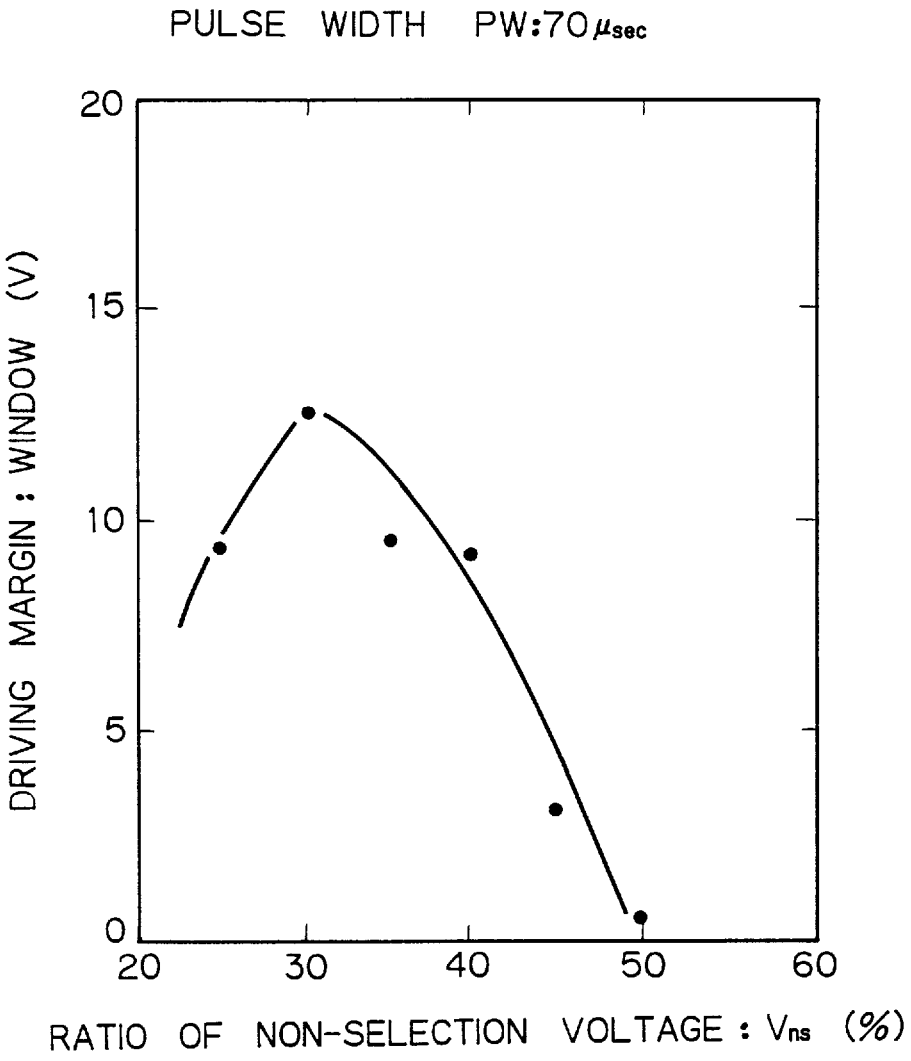
FIG. 7 is a diagram showing relationships between percentages of a non-selection voltage and light transmittance under the condition of 70 μsec. pulse width, for explaining the method of driving a ferroelectric liquid crystal display element according to the present invention.
Figure 8:
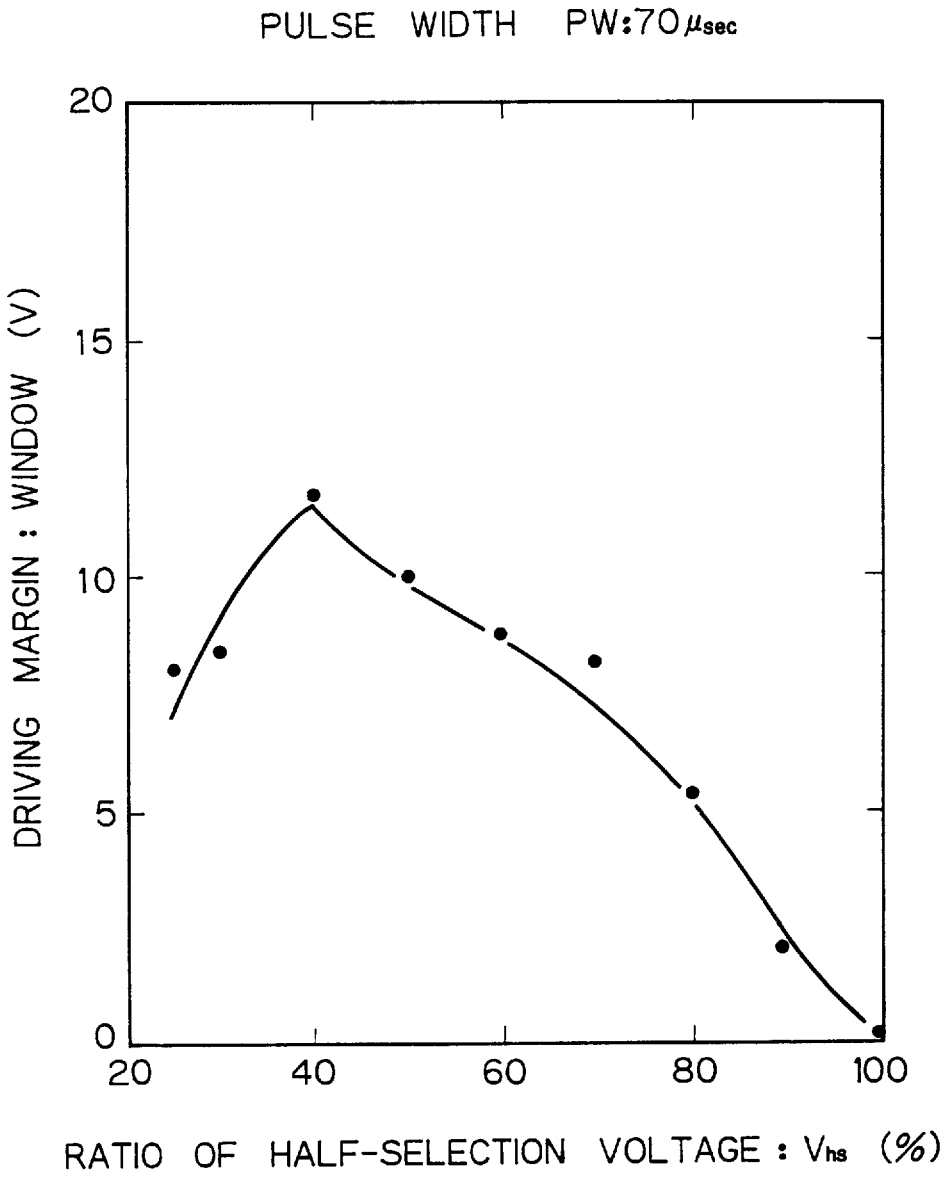
FIG. 8 is a diagram showing relationships between percentages of a half-selection voltage and light transmittance under the condition of 70 μsec. pulse width, for explaining the method of driving a ferroelectric liquid crystal display element according to the present invention.

FIGS. 5 and 7 show relationships between percentages of the non-selection voltage Vns and light transmittance, for explaining the method of driving a ferroelectric liquid crystal display element according to the present invention, and FIGS. 6 and 8 show relationships between percentages of the half-selection voltage Vhs and light transmittance. The pulse width of a drive voltage of FIGS. 5 and 6 is 100 μsec., and that of FIGS. 7 and 8 is 70 μsec.

FIG. 5 shows driving margins (windows) obtained by the conditions that a pulse width of a drive voltage is determined to 100 μsec., the selection voltage Vs is determined to twice as large as the half-selection voltage Vhs (Vs=2Vhs), and a ratio of the non-selection voltage Vns to the selection voltage Vs is changed from 25% to 50%. As shown in FIG. 5, the wave height value (voltage level) of the selection voltage Vs, which realizes a contrast ratio of at least 10:1, is changed in accordance with the percentage (ratio) of the non-selection voltage Vns. Namely, in response to a change in the non-selection voltage Vns with the selection voltage Vs keeping the same wave height value, i.e., a contrast ratio can be changed without changing the selection voltage Vs.

FIG. 6 shows driving margins (windows) obtained by the condition that the pulse width of the drive voltage is determined to 100 μsec., the selection voltage Vs is determined to four times as large as the non-selection voltage Vns (Vs=4Vns), and a ratio of the half-selection voltage Vhs to the selection voltage Vs is changed from 25% to 100%. As shown in FIG. 6, in response to a change in a ratio of the half-selection voltage Vhs to the selection voltage Vs with the selection voltage Vs being unchanged, a contrast ratio can be changed.

FIGS. 7 and 8 correspond to FIGS. 5 and 6. In FIGS. 7 and 8, however, a pulse width of a drive voltage is determined to 70 μsec. As is apparent from the comparisons between FIGS. 5 and 7 and between FIGS. 6 and 8, shortening the pulse width of the drive voltage from 100 μsec. to 70 μsec. substantially and uniformly reduces the driving margin (window). In this way, pulse modulation method is carried out in response to changes in bias ratios and relative values of the Vs, Vhs, and Vns, so that the number of gray scales (gradations) can be increased.

FIGS. 9 to 12 show signal waveforms according to first to fourth embodiments, respectively, of the present invention method of driving a ferroelectric liquid crystal display element.

Figure 9:
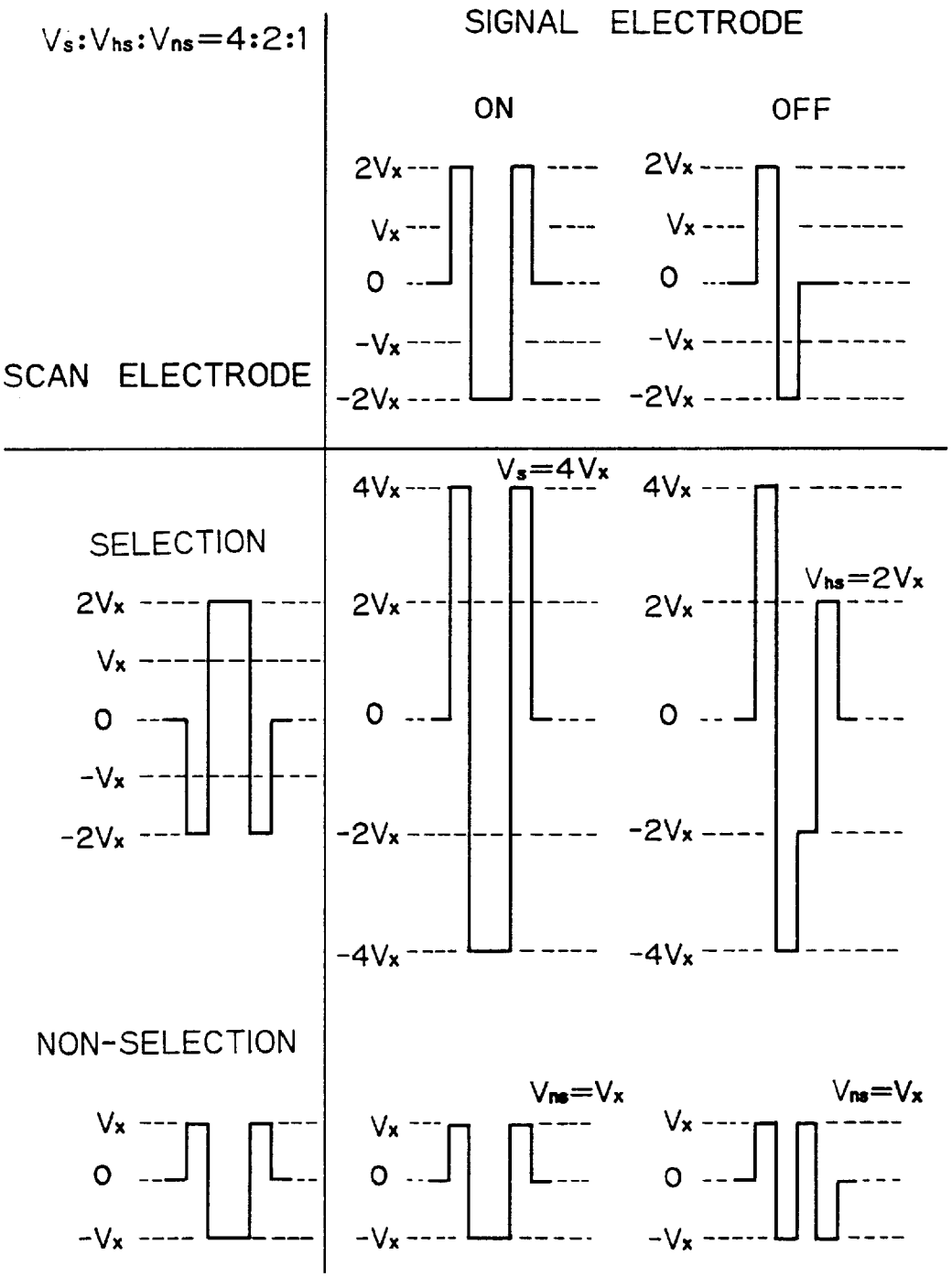
FIG. 9 is a diagram showing signal waveforms according to a first embodiment of the method of driving a ferroelectric liquid crystal display element according to the present invention.
Figure 10:
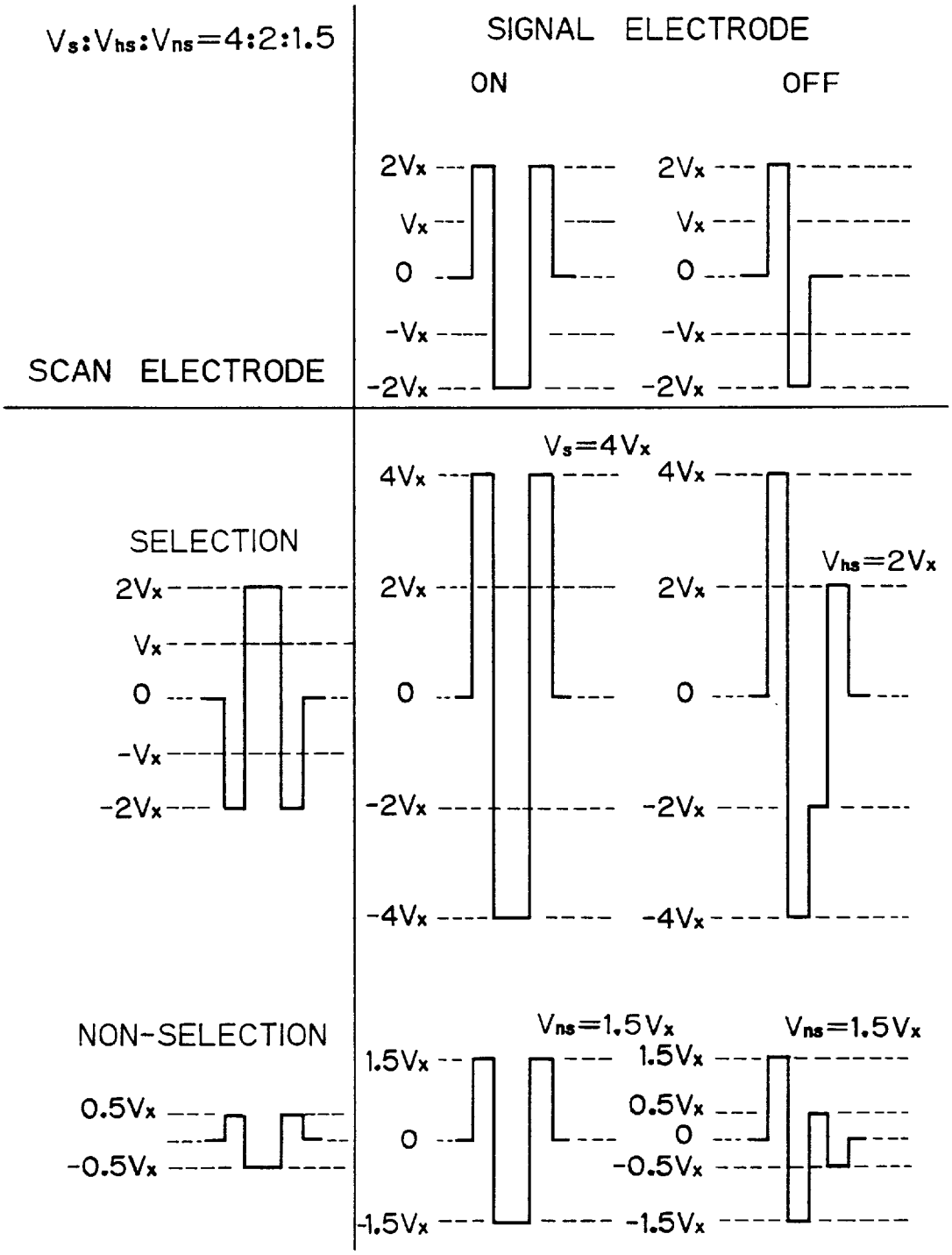
FIG. 10 is a diagram showing signal waveforms according to a second embodiment of the method of driving a ferroelectric liquid crystal display element according to the present invention.
Figure 11:
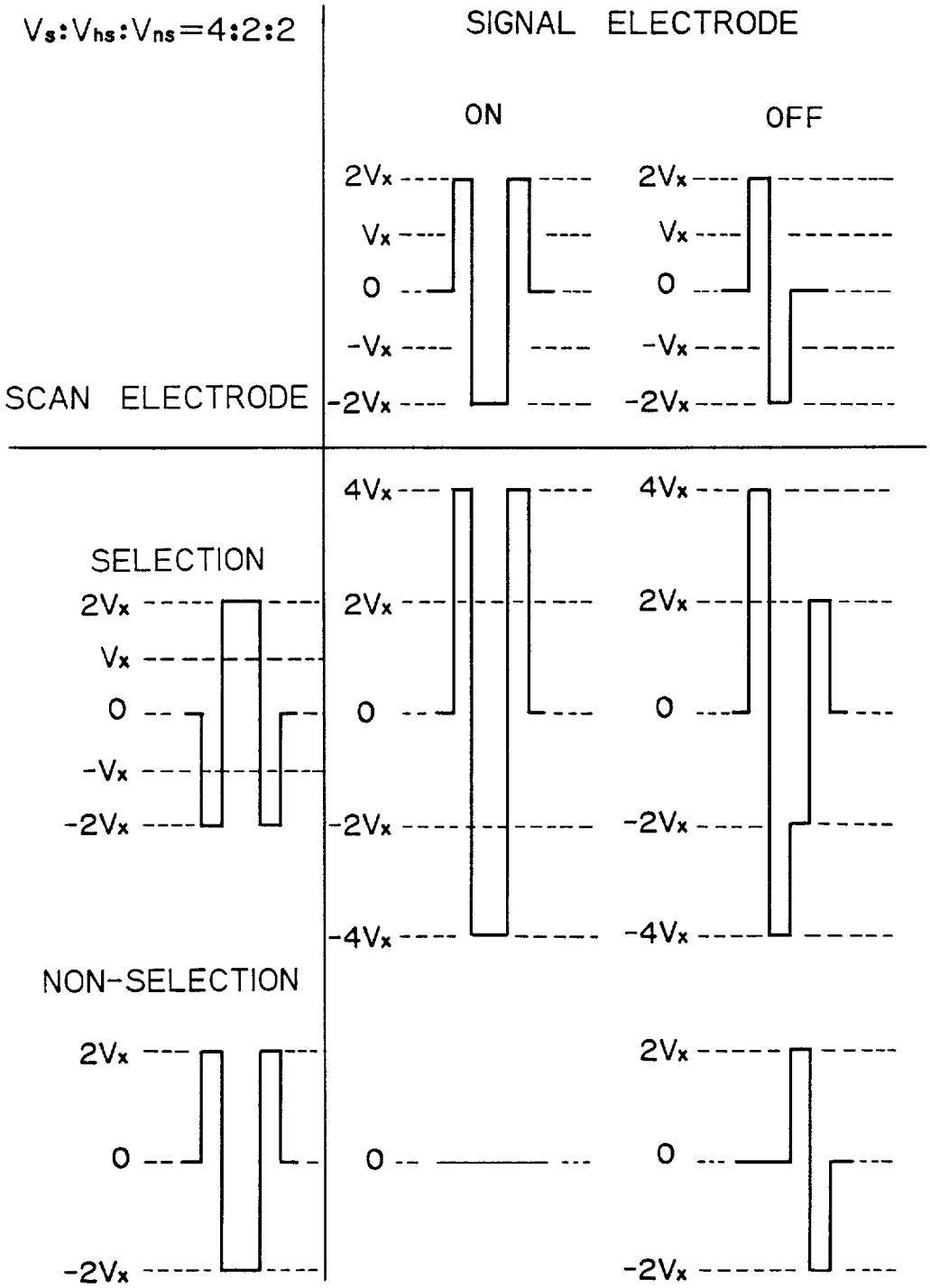
FIG. 11 is a diagram showing signal waveforms according to a third embodiment of the method of driving a ferroelectric liquid crystal display element according to the present invention.
Figure 12:
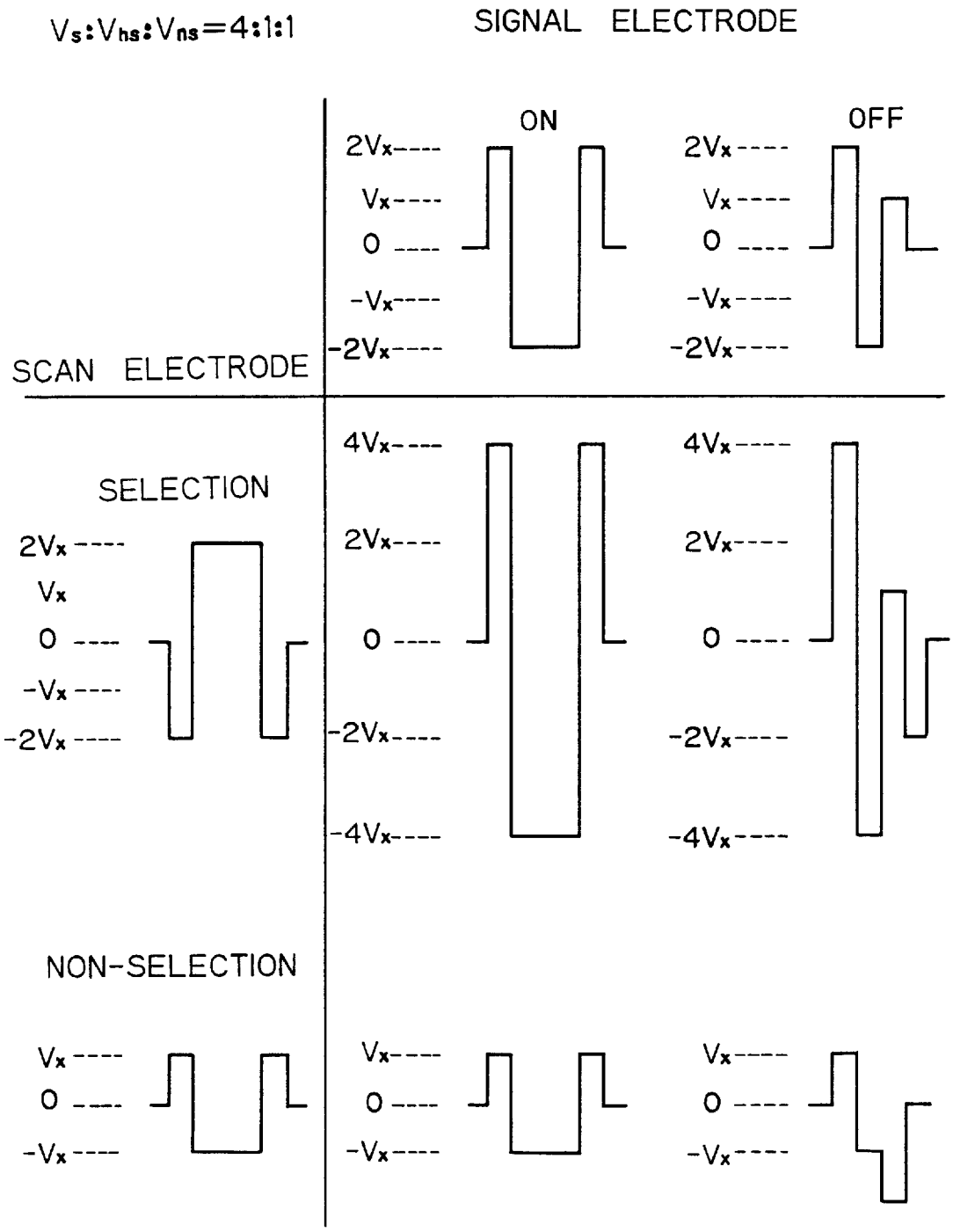
FIG. 12 is a diagram showing signal waveforms according to a fourth embodiment of the method of driving a ferroelectric liquid crystal display element according to the present invention.

When actually driving a liquid crystal display (an FLCD) having ferroelectric liquid crystal, waveforms having peak values shown in FIGS. 9 to 12 are applied to the scan and signal electrodes of the display. The drive waveforms of FIG. 9 are based on the selection voltage Vs, half-selection voltage Vhs, and non-selection voltage Vns of a ratio (Vs:Vhs:Vns) of 4:2:1. The drive waveforms of FIG. 10 are based on a ratio (Vs:Vhs:Vns) of 4:2:1.5. The drive waveforms of FIG. 11 are based on a ratio (Vs:Vhs:Vns) of 4:2:2. The drive waveforms of FIG. 12 are based on a ratio (Vs:Vhs:Vns) of 4:1:1.

Table 1 shows light transmittance values with respect to non-selection voltages Vns of the respective waveforms with the transmittance for the selection voltage Vs being set as 100%. As is apparent from Table 1, contrast ratios for displaying gradations can be changed by multiple-driving the display element according to drive waveforms that change the relative values of the selection voltage Vs, half-selection voltage Vhs, and non-selection voltage Vns.

TABLE 1

| Light transmittance under Vns | | |
|---|---|---|
| Waveform | Transmittance (%) under Vns | Contrast ratio |
| FIG. 9 | 3.1 | 32.3 |
| FIG. 10 | 8.6 | 11.6 |
| FIG. 11 | 14.0 | 7.1 |
| FIG. 12 | 15.5 | 6.5 |

In this way, pulse signals having the waveforms of FIGS. 9 to 12 are applied to the scan and signal electrodes to drive the ferroelectric liquid crystal display element, so that the display element may display different gradations. Pulse modulation may also be employed so that, for example, four levels of 0.5 V, 1.0 V, 1.5 V, and 2.0 V may be applied to the scan electrodes. In addition, the pulse width PW of the pulse signal may be modulated to 100 μsec. or 70 μsec., to realize eight black and white gradations (gray scales) in total. Consequently, when this is combined with an RGB micro-color filter used for an STN-LCD to display colors, eight gradations will be realized for each of R (red), G (green), and B (blue). This means that 512 colors (8×8×8=512) are realized on a panel screen, to display full colors. A ratio (Vs:Vhs:Vns) between the selection voltage Vs, half-selection voltage Vhs, and non-selection voltage Vns may take various values in addition to 4:2:1, 4:2:1.5, 4:2:2, and 4:1:1 shown in FIGS. 9 to 12.

In the above descriptions, the eight black and white gradations (gray scales) can be realized by using the pulse modulation method. However, according to the present invention, when a naphthalene-based liquid crystal material having a bookshelf structure (layer structure) and SSFLC structure, at least eight black and white gradations (gray scales) can be obtained at a temperature from 0° C. to 40° C., or at least sixteen black and white gradations can be obtained at a temperature from 5° C. to 40° C. Further, a method of driving a ferroelectric liquid crystal display element according to the present invention can use not only the pulse modulation method, but also can use a domain size control method and dithering method to increase the gradations with the ferroelectric liquid crystal display element.

The levels of the drive waveforms of FIGS. 9 to 12 may be changed for every frame and applied to the liquid crystal display element, to further increase the gradations. For example, when writing 30 frames per second on a screen, the voltage levels of FIGS. 9 to 11 may be used for writing every 10 frames, or the level of FIG. 9 may be used for writing all of the 30 frames. In these two cases, the latter case presents a higher contrast ratio when observed. In this way, voltage levels may be changed for every frame or every several frames, to realize multiple gradations.

As described above, the present invention provides a method of driving a ferroelectric liquid crystal display element according to a drive signal involving a selection voltage Vs, half-selection voltage Vhs, and non-selection voltage Vns. A relative ratio between the selection voltage Vs, half-selection voltage Vhs, and non-selection voltage Vns, or the absolute levels thereof are changed to display a plurality of gradations with the ferroelectric liquid crystal display element.

The method of driving a ferroelectric liquid crystal display element according to the present invention changes a relative ratio (Vs:Vhs:Vns) between the selection voltage Vs, half-selection voltage Vhs, and non-selection voltage Vns to, for example, 4:2:1, 4:2:1.5, 4:2:2, or 4:1:1, thereby displaying a plurality of gradations with the ferroelectric liquid crystal display element.

The method of driving a ferroelectric liquid crystal display element according to the present invention changes the absolute voltage level of, for example, the selection voltage Vs among the selection voltage Vs, half-selection voltage Vhs, and non-selection voltage Vns, to display a plurality of gradations with the ferroelectric liquid crystal display element. Changing the voltage level of the selection voltage Vs changes the voltage levels of the half-selection voltage Vhs and non-selection voltage Vns accordingly.

In this way, the present invention effectively displays gradations with the ferroelectric liquid crystal display element.

Figure 13:
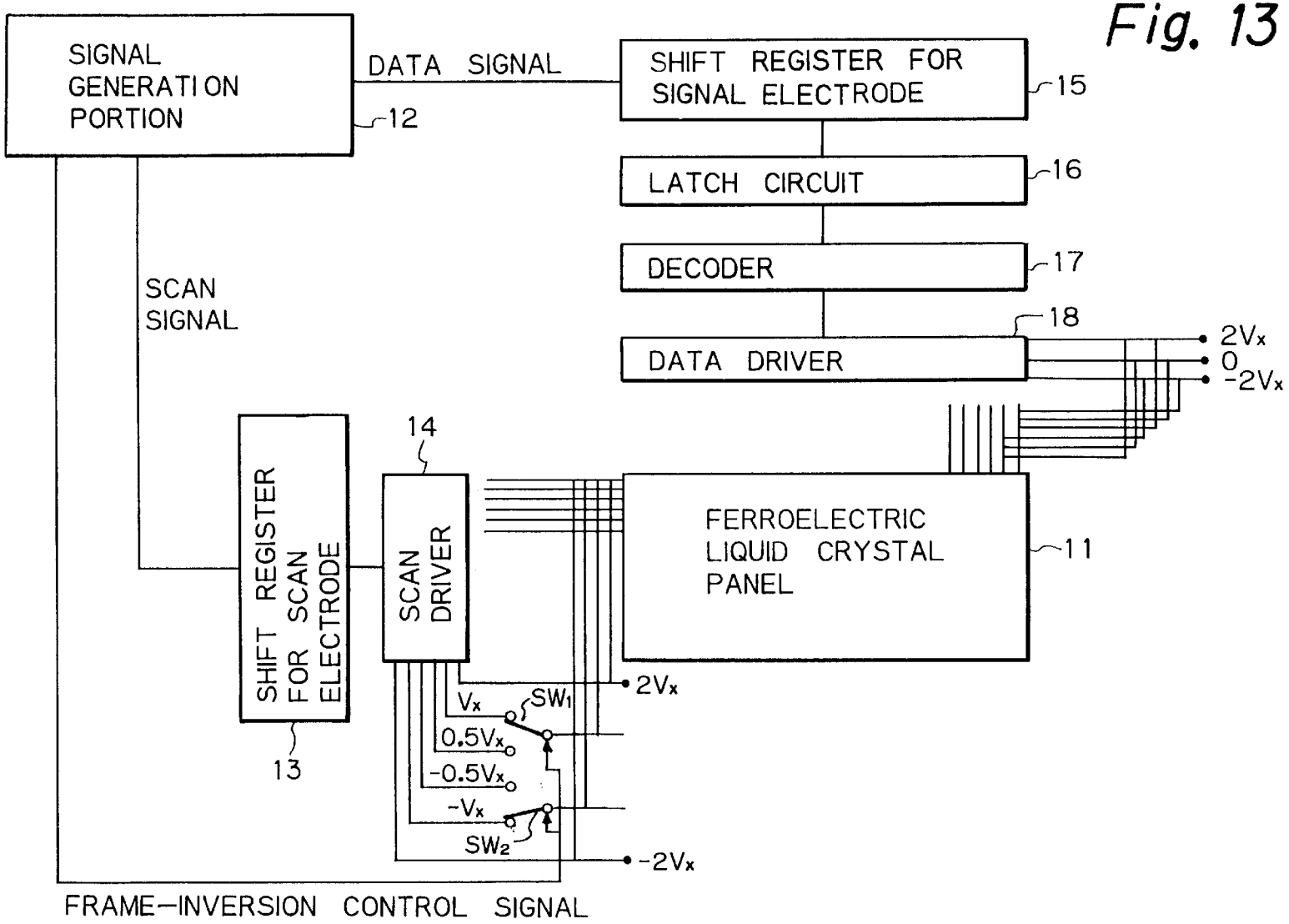
FIG. 13 is a diagram showing an example of a total configuration of a ferroelectric liquid crystal display device employing the method of driving a ferroelectric liquid crystal display element according to the present invention.

FIG. 13 shows an example of a total configuration of a ferroelectric liquid crystal display device employing the method of driving a ferroelectric liquid crystal display element according to the present invention. In FIG. 13, a reference numeral 11 denotes a ferroelectric liquid crystal panel, 12 denotes a signal generation portion, 13 and 15 denote shift registers, 14 denotes a scan driver, 16 denotes a latch circuit, 17 denotes a decoder, and 18 denotes a data driver.

The signal generation portion 12 outputs scan signals, data signals, and frame-inversion control signals. The scan signals are supplied to the scan driver 14 through the shift register 13, and the data signals are supplied to the data driver 18 through the shift register 15, the latch circuit 16 and the decoder 17. The frame-inversion control signals are supplied to switch elements $SW_1$ and $SW_2$.

As shown in FIG. 13, voltage levels 2Vx, 0 and −2Vx are applied to the data driver 18, and voltage levels 2Vx, Vx, 0.5Vx, −0.5Vx, −Vx and −2Vx are applied to the scan driver 14. Note, the voltage levels Vx and 0.5Vx are selected by the switch element $SW_1$ in accordance with the frame-inversion control signals output from the signal generation portion 12. Similarly, the voltage levels −Vx and −0.5Vx are selected by the switch element $SW_2$ in accordance with the frame-inversion control signals output from the signal generation portion 12. Consequently, various driving signals can be applied to each ferroelectric liquid crystal display element. Note, the ferroelectric liquid crystal display device applying the present invention method can be easily obtained by modifying some portions (for example, the scan driver 14, data driver 18, switch elements $SW_1$ and $SW_2$, and the like).

Figure 14A:
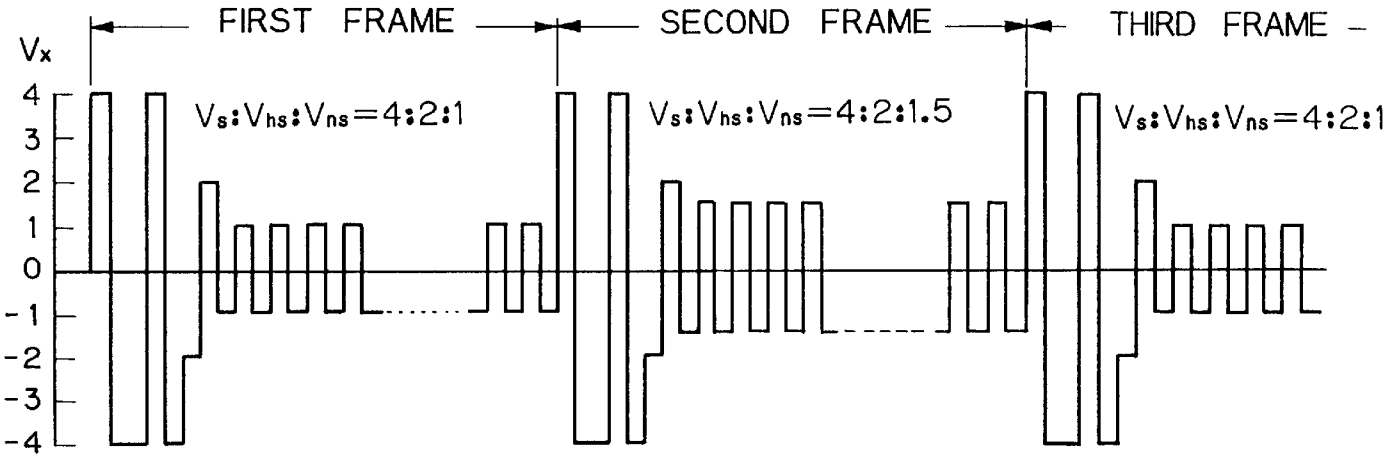
FIGS. 14A and 14B are diagrams showing examples of signal waveforms of the ferroelectric liquid crystal display device shown in FIG. 13.
Figure 14B:
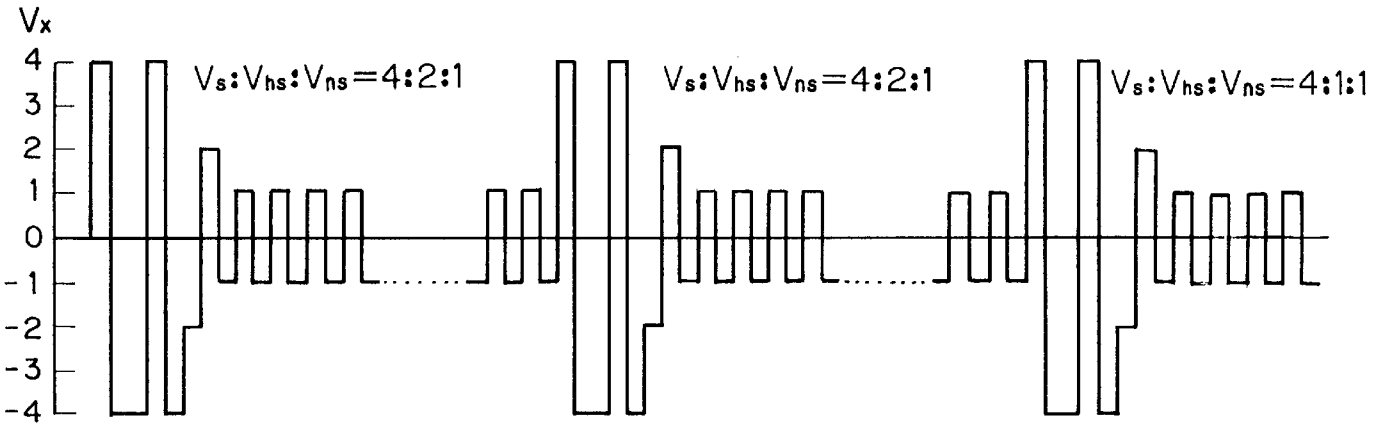

FIGS. 14A and 14B show examples of signal waveforms of the ferroelectric liquid crystal display device shown in FIG. 13.

As shown in FIG. 14A, in a first frame, a relative ratio between the selection voltage Vs, half-selection voltage Vhs, and non-selection voltage Vns of the drive signal is determined to 4:2:1, i.e., Vs:Vhs:Vns=4:2:1. Similarly, in a second frame, Vs:Vhs:Vns=4:2:1.5, and in a third frame, Vs:Vhs:Vns=4:2:1. Namely, in the case of FIG. 14A, the relative ratio between the selection voltage Vs, half-selection voltage Vhs, and non-selection voltage Vns of the drive signal is changed for every frame. Note, in each of the frames, different gradations are displayed on the ferroelectric liquid crystal display device.

On the other hand, as shown in FIG. 14B, in a first frame, a relative ratio between the selection voltage Vs, half-selection voltage Vhs, and non-selection voltage Vns of the drive signal is determined to 4:2:1, i.e., Vs:Vhs:Vns=4:2:1. Similarly, in a second frame, Vs:Vhs:Vns=4:2:1, and in a third frame, Vs:Vhs:Vns=4:1:1. Namely, in the case of FIG. 14B, the relative ratio between the selection voltage Vs, half-selection voltage Vhs, and non-selection voltage Vns of the drive signal is changed for every several frames. Note, in the first and second frames, the same gradation is displayed on the ferroelectric liquid crystal display device.

As shown in FIGS. 14A and 14B, the relative ratio between the selection voltage Vs, half-selection voltage Vhs, and non-selection voltage Vns of the drive signal is changed for every frame or every several frames and applied to the ferroelectric liquid crystal display element.

Note, the absolute levels of the selection voltage Vs, half-selection voltage Vhs, and non-selection voltage Vns of the drive signal can be also changed for every frame or every several frames and applied to the liquid crystal display element. Namely, the basic voltage Vx can be changed for every frame or every several frames.

In the above descriptions, the present invention method can also use the conventional methods (a domain size control method, pulse modulation method, dithering method, and the like), as the present invention method and the conventional methods can be independently applied to a ferroelectric liquid crystal display element to increase the number of gray scales (gradations). Further, the present invention method can be applied not only to OA-equipment such as word processors and personal computers, but also applied to an electronic OHP display, and the like.

As explained above in detail, the method of driving a ferroelectric liquid crystal display element according to the present invention provides a function of displaying many gradations for a display that employs ferroelectric liquid crystals to achieve wide viewing angle, high information content, and high-speed response. Consequently, the present invention realizes a flat panel display for OA-equipment, having a large screen to display full colors at high resolution and excellent quality.

Many widely differing embodiments of the present invention may be constructed without departing from the spirit and scope of the present invention, and it should be understood that the present invention is not limited to the specific embodiments described in this specification, except as defined in the appended claims.

We claim:

1. A method of directly driving a surface-stabilized ferroelectric liquid crystal in a simple matrix liquid crystal display which comprises a first substrate including a plurality of first electrodes, a second substrate including a plurality of second electrodes disposed orthogonally to said first electrodes and defining cross portions therebetween, and a plurality of surface-stabilized ferroelectric liquid crystal display elements, a respective surface-stabilized ferroelectric liquid crystal element being provided at each cross portion between said first electrodes and said second electrodes, each surface-stabilized ferroelectric liquid crystal display element being driven by a drive signal, the method comprising:

a) defining plural drive signal levels of the drive signal in accordance with selectable, plural, different combinations of respective levels of a selection voltage, a half-selection voltage, and a non-selection voltage, the plural different combinations comprising plural, different relative ratios of the respective levels of the selection, half-selection and non-selection voltages and respectively displaying plural different gradations of a surface-stabilized ferroelectric liquid crystal display element to which the drive signal is applied;

b) setting a relative ratio of the respective levels of the selection voltage, the half-selection voltage, and the non-selection voltage of the drive signal for a corresponding frame interval, selected as one of every individual frame and every several frames, to display the respective gradation of the surface-stabilized ferroelectric liquid crystal display element, the relative ratio of the respective levels of the selection voltage, the half-selection voltage, and the non-selection voltage of the drive signal, as set, being maintained during the corresponding frame interval and being selectively changeable for successive corresponding frame intervals; and b) applying the drive signal having the set relative ratio to the corresponding surface-stabilized ferroelectric liquid crystal display element to display the respective gradation during the corresponding frame interval.

2. A method of driving a surface-stabilized ferroelectric liquid crystal display element as claimed in claim 1, wherein said method further comprises a step of pulse width modulating the drive signal to increase the number of the respective, plural different gradations of the surface-stabilized ferroelectric liquid crystal display element.

3. A method of driving a surface-stabilized ferroelectric liquid crystal display element as claimed in claim 2, further comprising the substep of:

changing the pulse width of each of the selection voltage, the half-selection voltage, and the non-selection voltage of the drive signal to provide selective display of an increased number of respective, plural different gradations of the surface-stabilized ferroelectric liquid crystal display element.

4. A method of driving a surface-stabilized ferroelectric liquid crystal display element as claimed in claim 1, wherein said step a) further comprises performing a domain size control method on the drive signal to increase the number of respective, plural different gradations of the surface-stabilized ferroelectric liquid crystal display element.

5. A method of driving a surface-stabilized ferroelectric liquid crystal display element as claimed in claim 1, wherein said step a) further comprises performing a dithering control method on the drive signal to increase the number of respective, plural different gradations of the surface-stabilized ferroelectric liquid crystal display element.

6. A method of driving a surface-stabilized ferroelectric liquid crystal display element as claimed in claim 1, wherein said method further comprises the step of:

changing respective, absolute levels of the selection voltage, the half-selection voltage, and the non-selection voltage to display a plurality of gradations of the surface-stabilized ferroelectric liquid crystal display element.

7. A method of driving a surface-stabilized ferroelectric liquid crystal display element as claimed in claim 6, wherein said step b) further comprises the substeps of:

i) changing the respective absolute levels of the selection voltage, the half-selection voltage, and the non-selection voltage of the drive signal for every frame interval comprising an individual frame;

ii) maintaining the absolute levels, as changed for a respective frame interval comprising an individual frame, fixed for the duration of the respective individual frame; and iii) applying the drive signal having the fixed, respective absolute levels to the respective surface-stabilized ferroelectric liquid crystal display element during the respective individual frame.

8. A method of driving a surface-stabilized ferroelectric liquid crystal display element as claimed in claim 6, wherein said step b) further comprises the substeps of:

i) changing the respective absolute levels of the selection voltage, the half-selection voltage, and the non-selection voltage of the drive signal for every frame interval comprising every several frames;

ii) maintaining the absolute levels of the drive signal, as changed for a respective frame interval comprising every several frames, fixed for the duration of the respective, every several frames; and iii) applying the drive signal having the fixed, respective absolute levels to the respective surface-stabilized ferroelectric liquid crystal display element during the respective, every several frames.

9. A method of driving a surface-stabilized ferroelectric liquid crystal display element as claimed in claim 6, wherein said method further comprises the step of:

c) pulse width modulating the drive signal to increase the gradations of the surface-stabilized ferroelectric liquid crystal display element.

10. A method of driving a surface-stabilized ferroelectric liquid crystal display element as claimed in claim 9, further comprising the substep of changing the pulse width of each of the selection voltage, the half-selection voltage, and the non-selection voltage of the drive signal to provide selective display of an increased number of respective, plural different gradations on the surface-stabilized ferroelectric liquid crystal display element.

11. A method of driving a surface-stabilized ferroelectric liquid crystal display element as claimed in claim 6, wherein said method further comprises performing a domain size control method on the drive signal to increase the number of respective, plural different gradations of the surface-stabilized ferroelectric liquid crystal display element.

12. A method of driving a surface-stabilized ferroelectric liquid crystal display element as claimed in claim 6, wherein said method further comprises performing a dithering control method on the drive signal to increase the number of respective, plural different gradations of the surface-stabilized ferroelectric liquid crystal display element.

13. A method of driving a surface-stabilized ferroelectric liquid crystal display element as claimed in claim 6, wherein the number of plurality of gradations is between 8 to 16.

14. A method of driving a surface-stabilized ferroelectric liquid crystal display element as claimed in claim 1, wherein the drive signal comprises at least two positive voltage levels and two negative voltage levels and is applied to at least one of scan and signal electrodes of the surface-stabilized ferroelectric liquid crystal display element.

15. A method of driving a surface-stabilized ferroelectric liquid crystal display element as claimed in claim 14, wherein the at least two positive and at least two negative voltage levels of the drive signal are selectively changed for every frame interval, comprising an individual frame, and are maintained as fixed voltage levels, as changed, for the respective individual frame while being applied to the respective surface-stabilized ferroelectric liquid crystal display element.

16. A method of driving a surface-stabilized ferroelectric liquid crystal display element as claimed in claim 14, wherein the at least two positive and at least two negative voltage levels of the drive signal are selectively changed for the respective frame interval comprising every several frames and are maintained as fixed voltage levels, as changed, for the respective, every several frames while being applied to the respective surface-stabilized ferroelectric liquid crystal display element.

17. A method of driving a surface-stabilized ferroelectric liquid crystal display element as claimed in claim 14, wherein the voltage levels of the drive signal include at least two different pulse widths.

18. A method of driving a surface-stabilized ferroelectric liquid crystal display element as claimed in claim 14, wherein the number of plurality of gradations is between 8 to 16.

19. A method of directly driving a surface-stabilized ferroelectric liquid crystal display element in a simple matrix liquid crystal display which comprises a first substrate including a plurality of first electrodes, a second substrate including a plurality of second electrodes disposed orthogonally to and displaced from said first electrodes, and a plurality of surface-stabilized ferroelectric liquid crystal display elements, a respective surface-stabilized ferroelectric liquid crystal element being provided at each cross portion between said first electrodes and said second electrodes, the method comprising the steps of:

a) defining, in common and for each of the surface-stabilized ferroelectric liquid display crystal elements of the simple matrix liquid crystal display, an operative range of variable light transmittance from a minimum level of light transmittance to a maximum level of light transmittance;

b) defining a drive signal having plural different values determined by selectable different combinations, and corresponding different ratios, of respective, different voltage levels of a selection voltage, a half-selection voltage and a non-selection voltage;

c) correlating the plural different drive signal values to corresponding different gradations of the operative range of variable light transmittance, in common for the surface-stabilized ferroelectric liquid crystal display elements of the display;

d) defining a frame interval as a selected one of an individual frame and a group of several frames;

e) for each of successive frame intervals and for each display element of the display, defining the drive signal value for a respective display element in accordance with selecting the combination of respective, different voltage levels having the corresponding ratio correlated to the light transmittance gradation to be displayed in the respective frame interval; and f) applying a drive signal having the defined drive signal value to the respective display element during the corresponding frame interval and while maintaining the selected combination, and ratio, of the respective voltage levels of the selection, half-selection and non-selection voltages, and producing the correlated light transmission gradation in the respective display element and for the respective frame interval.

20. A method of directly driving a surface-stabilized ferroelectric liquid crystal element in a simple matrix liquid crystal display as recited in claim 19, further comprising:

in step (b), defining for each selectable ratio, selectable, different absolute levels of the respective voltage levels of the selection, half-selection and non-selection voltages and thereby providing further, selectable and different combinations of the respective different voltage levels; and in step (c), correlating the further, selectable and different combinations of the respective different voltage levels to corresponding, further gradations of the operative range of variable light transmittance.

21. A method of directly driving a surface-stabilized ferroelectric liquid crystal element in a simple matrix liquid crystal display as recited in claim 19, further comprising:

in step (b), defining, for each selectable, different ratio of the respective voltage levels of the selection, half-selection and non-selection voltages, selectable pulse width modulations and thereby providing further, selectable and different combinations of the respective different voltage levels; and in step (c), correlating the further, selectable and different combinations of the respective different voltage levels to corresponding, further gradations of the operative range of variable light transmittance.

22. A method of directly driving a surface-stabilized ferroelectric liquid crystal element in a simple matrix liquid crystal display as recited in claim 19, further comprising:

in step (b), defining, for each selectable ratio, selectable different absolute levels of the respective voltage levels of the selection, half-selection and non-selection voltages and, for each selectable absolute level, selectable pulse width modulation rates and thereby providing further, selectable and different combinations of the respective different voltage levels, and in step (c), correlating the further, selectable and different combinations of the respective different voltage levels to corresponding, further gradations of the operative range of variable light transmittance.

* * * * *